United States Patent [19]

Price et al.

[11] 4,441,429

[45] Apr. 10, 1984

[54] RETAINER FOR A PROJECTILE ROTATING BAND

[75] Inventors: Abner B. Price, King George; William S. Burnley, III, Dahlgren, both of Va.

[73] Assignee: The United States of America as represented by the Secretary of the Navy, Washington, D.C.

[21] Appl. No.: 333,607

[22] Filed: Dec. 23, 1981

[51] Int. Cl.[3] ..... F42B 31/00

[52] U.S. Cl. ..... 102/526; 102/501

[58] Field of Search ..... 102/501–503, 102/524–528, 517, 520–523; 411/517–519, 521, 530, 330; 24/155 SC, 155 SD

[56] References Cited

U.S. PATENT DOCUMENTS

| | | | |
|---|---|---|---|
| 1,007,223 | 10/1911 | McNair | 102/526 |
| 2,897,022 | 7/1959 | Marola | 411/518 X |
| 3,687,079 | 8/1972 | Scollins | 102/526 |
| 3,744,426 | 7/1973 | Butler | 102/94 |
| 4,109,582 | 8/1979 | Haep et al. | 102/526 |
| 4,197,801 | 4/1980 | LaFever et al. | 102/443 |

OTHER PUBLICATIONS

Simonds et al., "Nylon as a Plastic," *The New Plastics*, 1945, pp. 26–33.

*Primary Examiner*—Harold J. Tudor
*Assistant Examiner*—Tyrone Davis
*Attorney, Agent, or Firm*—R. F. Beers; K. E. Walden; W. R. Henderson

[57] ABSTRACT

A retainer for attaching a rotating band to a projectile during handling and ramming of the projectile. The retainer cooperates with a groove on the projectile and is discarded during firing of the projectile by the force of the charge. An interlocking double split ring forms the retainer with an outer ring having an L-shaped cross-section and an inner ring shaped to fit into the L-shape of the outer ring. Each ring is provided with a split or opening to allow for expansion of the ring over the projectile and into the projectile groove. The outer ring split may be cut at an angle of less than 90° to minimize deflection of the outer ring. The inner and outer rings are assembled with their splits together and then clocked 180° apart. The inner ring is then locked to the outer ring by a locking notch. Hoop stress of the outer ring prevents the inner ring from deflecting at the split such that the retainer is forced to behave as a continuous single ring.

11 Claims, 6 Drawing Figures

RETAINER FOR A PROJECTILE ROTATING BAND

BACKGROUND OF THE INVENTION

The present invention relates to a retainer for a projectile, and more specifically to a retainer for attaching the rotating band to a projectile.

A spin stabilized projectile developes a spin or rotational motion about its longitudinal axis as the projectile moves through a gun barrel. The projectile carries a rotating band which is a ring-like member attached to the after end of the projectile that protrudes circumferentially from the projectile body so as to engage the gun barrel rifling. During firing of the projectile, the rotating band engraves into the rifling grooves and imparts spin to the projectile. In addition, the rotating band acts as an obturator to prevent leakage of the charge gases between the projectile body and the gun barrel.

During handling and ramming of the projectile in the gun barrel, the rotating band must be retained on the projectile body so as to insure torque transfer from the rifling grooves of the gun barrel to the projectile.

Prior art methods of attaching a rotating band to a projectile include the apparatus disclosed in U.S. Pat. No. 1,007,223 to McNair. The retaining device of McNair utilizes an abutment member to secure the rotating band to the projectile. The abutment member is positioned and secured on the projectile by a split spring ring which cooperates with a groove in the projectile.

Another prior art method of retaining a rotating band on a projectile is disclosed in U.S. Pat. No. 3,744,426, to Butler. The Butler patent discloses the retention of a thermoplastic rotating band by a thermoplastic retaining ring cooperating with a groove in the projectile to abut the rotating band.

The disadvantage of both the Butler and McNair devices is that during high ramming speeds encountered in modern weapons systems the retainers disclosed by Butler and McNair fail to securely attach the rotating bands to the projectiles. At ramming speeds of greater than 21 feet per second the retainer disengages from the projectile groove causing the projectile to move forward in the gun barrel. The forward movement of the projectile can cause the rotating band to lose the gas seal with the rifling grooves thus resulting in a decrease in both projectile velocity and projectile range.

The retainer of the subject invention enables the projectile to withstand ramming speeds up to 26 feet per second without disengagement of the retainer from the projectile groove.

SUMMARY OF THE INVENTION

Accordingly, there is provided in the present invention a retainer for attaching a rotating band to a projectile. The retainer enables the projectile to withstand ramming speeds up to 26 feet per second without disengagement of the retainer from the projectile groove.

The retainer is constructed with an interlocking double split ring which cooperates with a groove on the projectile so as to axially secure the rotating band to the projectile. The retainer is discarded during firing of the projectile by the force of the charge. The interlocking double ring is formed with an outer ring having an L-shaped cross-section and an inner ring having a rectangular cross-section of sufficient dimension to fit into the L-shape of the outer ring. Both the outer and inner rings are provided with a split or opening which allows the rings to expand over the projectile and fit into the projectile groove. The L-shaped cross-section of the outer ring, while preferably 90°, may be shaped to form an acute angle between the legs of the L with a corresponding adjustment in the rectangular cross-section of the inner ring to form a trapezoid.

The outer ring split may be cut at an angle of less than 90° to minimize deflection of the outer ring when subjected to the stress of ramming the projectile in the gun barrel.

The inner ring is assembled in the outer ring with their splits together. The inner and outer ring are expanded over the end of the projectile and into the projectile groove. The rings are then rotated relative to each other until their splits are 180° apart. The inner ring is locked to the outer ring by a locking notch which is received either by the split of the inner ring or a depression in the outer circumference of the outer ring.

When the projectile is rammed in the gun barrel, hoop stress of the outer ring prevents the inner ring from deflecting at the inner ring split such that the retainer is forced to behave as a continuous single ring.

OBJECTS OF THE INVENTION

It is an object of the present invention to provide a retainer for attaching a rotating band to a projectile.

Another object of the present invention is to provide a retainer for a projectile rotating band which prevents disengagement of the retainer from the projectile under high ramming speeds.

A further object of the present invention is to provide a projectile rotating band retainer which insures engagement of the rotating band with the gun barrel rifling grooves during ramming of the projectile.

A still further object of the present invention is to provide a projectile rotating band retainer which maximizes projectile range and accuracy.

Other objects, advantages, and novel features of the present invention will become apparent from the following detailed description of the invention when considered in conjunction with the drawings.

BRIEF DESCRIPTION OF THE DRAWINGS

A more complete appreciation of the invention and many of the attendant advantages thereof will be readily understood by reference to the following detailed description when considered with the accompanying drawings in which like reference numerals designate like parts throughout the figures and wherein.

DESCRIPTION OF THE PREFERRED EMBODIMENT

Figure 1:
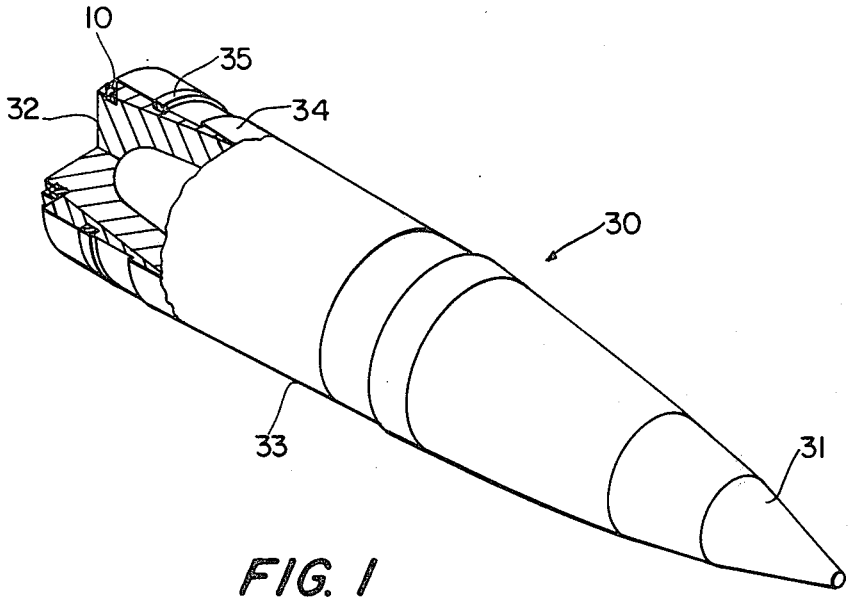
FIG. 1 illustrates a cutaway isometric view of a projectile incorporating the retainer of the subject invention.

Referring to FIG. 1, there is illustrated a cutaway isometric view of a projectile 30 incorporating the retainer 10 of the subject invention. The projectile is provided with a projectile nose 31, a projectile tail 32, and a projectile body 33. The after section of the projectile is shown as supporting a rotating band 34, having in turn a heat resistant ring 35, for imparting spin to the projectile in cooperation with the rifling grooves of the gun barrel and also forming a gas seal with the gun barrel. Retainer 10 is illustrated as cooperating with a groove in the tail of the projectile to attach rotating band 34 with heat resistant ring 35 to the projectile.

Referring now to FIGS. 2 through 6, it can be seen that retainer 10 is constructed as an interlocking double split ring with outer ring 13 and inner ring 12. Outer ring 13 and inner ring 12 may be constructed of molded or machined plastic, Teflon or nylon material imparted with hoop stress to enable the retainer to grip the projectile. The retainer is constructed of nylon or like material, as opposed to metal, because such material reduces the personnel danger due to fragmentation when the retainer is discarded during firing.

Figure 2:
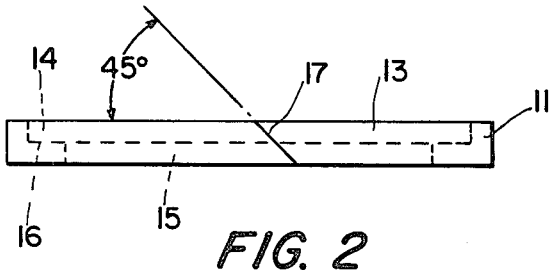
FIG. 2 illustrates a front view of the outer ring of the retainer.
Figure 3:
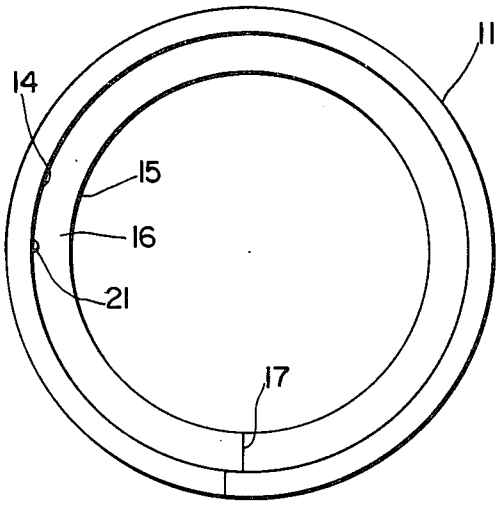
FIG. 3 illustrates a plan view of the outer ring of the retainer.

FIGS. 2 and 3 illustrate the outer ring which is provided with an L-shaped cross-section 11 formed by maximum diameter cavity 14 extending axially into the ring minimum diameter cavity 15. Maximum diameter 14 and minimum diameter 15 create a shoulder 16 and impart the L-shape to the cross-section of outer ring 13. Outer ring 13 is also provided with a split or opening 17 which allows the ring to be expanded over the tail portion of the projectile and into the projectile groove. As shown in FIG. 2, split 17 is cut at an angle of 45°, although it is to be understood that split 17 can be any convenient angle, including a 90° angle, as dictated by the particular application.

Figure 4:
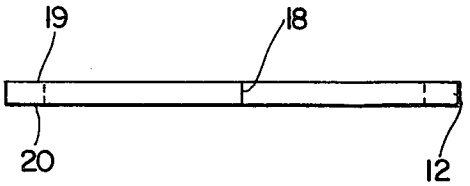
FIG. 4 illustrates a front view of the inner ring and retainer.
Figure 5:
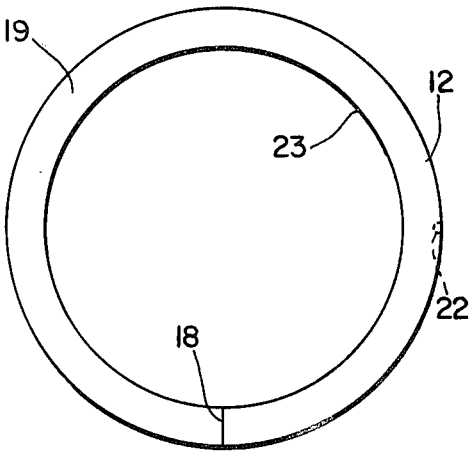
FIG. 5 illustrates a plan view of the inner ring of the retainer.

Referring to FIGS. 4 and 5, there is illustrated the inner ring 12. The inner ring is formed with an axially extending through passage 23 which forms the ring. The inner ring is provided with upper abutting surface 19 and lower abutting surface 20 and an opening or split 18. The split 18 is illustrated here as being at a 90° angle to the body of the ring although it should be understood again that split 18 may be any convenient angle depending on the particular application.

Referring again to FIG. 3, the outer ring 13 is provided with a means for locking the outer ring relative to the inner ring so as to prevent relative rotation thereof. The outer ring is provided with a locking projection 21 which cooperates with either a locking groove 22 of inner ring 12, illustrated in FIG. 5, or with split or opening 18 of inner ring 12, to lock the rings against relative rotation.

Figure 6:
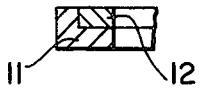
FIG. 6 illustrates a cross-section of the inner ring assembled in the outer ring to form the retainer.

The retainer is assembled as illustrated in cross-section in FIG. 6 by inserting inner ring 12 into the L-shape of outer ring 13 so that lower abutting surface 20 seats against shoulder 16 of outer ring 13. The rings are assembled with their splits together and expanded over the tail of the projectile and into the projectile groove. The outer ring is then rotated or clocked relative to the inner ring until the locking projection 21 seats in the locking depression 22. Alternatively, the locking projection can be seated in split 18 of the inner ring. When the projection seats in the depression, the outer ring is prevented from rotating relative to the inner ring and axially secures the rotating ring to the projectile.

Although the outer ring is illustrated as having an L-shaped cross-section with a 90° angle between the legs of the L, it is to be understood that the legs of the L-shape can form a less than 90° angle with a corresponding angular change in the cross-section of the inner ring to form a trapezoidal cross-section.

It is thus apparent that the disclosed retainer for a projectile rotating band provides a means for securing the rotating band so as to prevent disengagement of the rotating band from the projectile at high ramming speeds. By insuring engagement of the rotating band with the projectile and rifling grooves of the gun barrel, the retainer maximizes the projectile velocity and range.

Many obvious modifications and embodiments of the specific invention other than those set forth above will readily come to mind to one skilled in the art having the benefit of the teaching presented in the foregoing description and the accompanying drawings of the subject invention, and hence it is to be understood that such modifications are included within the scope of the appended claims.

What is claimed as new and desired to be secured by Letters Patent of the United States is:

1. A retainer for securing a rotating band to a projectile comprising:

a first expandible split ring developing a hoop stress;

a second expandible split ring positioned inside of said first ring, said rings having limited relative movement therebetween from an orientation whereat the respective splits are positioned to allow simultaneous expansion of said rings over the projectile to be received in a groove thereon to an orientation whereat the splits are spaced apart when in the groove for applying the hoop stress developed by said first ring to oppose expansion of said second ring, said rings thereby defining a continuous single ring in the groove; and, means associated with said rings for preventing the relative movement therebetween when the splits are spaced apart.

2. The retainer as defined in claim 1 wherein said first expandible split ring has an L-shaped cross-section.

3. The retainer as defined in claim 2 wherein said second expandible split ring has a cross-sectional shape to fit contiguously within the L-shaped outer ring.

4. The retainer as defined in claim 1 or 3 wherein said means for preventing relative motion comprises:

a projection on said first ring inner surface; and, a locking groove on said second ring outer surface to receive said projection therein.

5. A device for axially retaining a rotating band on a projectile comprising:

an outer expandible ring having a first radial split therethrough developing a hoop stress;

an inner expandible ring having a second radial split therethrough assembled inside of said outer ring, said outer and inner ring assembly adapted to be positioned in a groove on the projectile adjacent the rotating band with the respective splits oriented 180 degrees apart; and, means associated with said inner and outer rings for preventing relative rotation therebetween when the splits are orientated 180 degrees apart, whereby the hoop stress developed by said outer ring resists expansion of said inner ring and said rings cooperate to resist radial expansion and removal from the projectile groove providing increased axial retention of the rotating band over the axial retention provided by a single split ring and substantially approximating the axial retention provided by a single, continuous unsplit ring in the groove.

6. The device as defined in claim 5 wherein said outer expandible split ring has an L-shaped cross-section.

7. The device as defined in claim 6 wherein said inner expandible split ring has a cross-sectional shape to fit contigiously within the L-shaped outer ring.

8. The device as defined in claim 5 wherein said means for preventing relative rotation comprises:

a projection on said outer ring inner surface; and, a locking groove on said inner ring outer surface to receive said projection therein.

9. The device as defined in claim 7 wherein said means for preventing relative rotation comprises:

a projection on said outer ring inner surface; and, a locking groove on said inner ring outer surface to receive said projection therein.

10. A retainer for securing a rotating band to a projectile comprising:

an expandible outer split ring having an L-shaped cross-section;

an expandible inner split ring having a cross-sectional shape to fit contiguously within the L-shaped outer ring, said rings adapted to assume a position whereat the respective splits are orientated to allow expansion of said rings over the projectile into a groove thereon, and further adapted to assume a position whereat said splits are orientated substantially spaced apart for defining a single continuous ring in the groove; and, means associated with said rings for locking said rings in the position whereat the splits are orientated substantially spaced apart.

11. The retainer as defined in claim 10 wherein said means for locking rings comprises:

a projection located on said outer ring inner surface;

a locking groove located on said inner ring outer surface to receive said projection therein.

* * * * *